United States Patent [19]

Lewis, Jr. et al.

[11] Patent Number: 4,654,746

[45] Date of Patent: Mar. 31, 1987

[54] STATIC DISSIPATOR FOR ELECTRONIC DEVICES

[76] Inventors: Robert O. Lewis, Jr., 13352 W. Jewell Dr., Lakewood, Colo. 80228; Lawrence J. Putz, 6082 W. Adler Ave., Littleton, Colo. 80123

[21] Appl. No.: 674,001

[22] Filed: Nov. 23, 1984

[51] Int. Cl.[4] ..... H05F 3/00

[52] U.S. Cl. ..... 361/212; 361/220

[58] Field of Search ..... 361/212, 220

[56] References Cited

U.S. PATENT DOCUMENTS 3,780,345 12/1973 Earman, Jr. ..... 361/220

3,917,978 11/1975 Menzel et al. ..... 361/220

*Primary Examiner*—L. T. Hix

*Assistant Examiner*—Douglas S. Lee

*Attorney, Agent, or Firm*—Edwin L. Spangler, Jr.

[57] ABSTRACT

This invention relates to a protective device for dissipating static electrical charges in the order of magnitude of 30,000 volts which if transferred by a person to a computer terminal or other piece of electronic equipment requiring such protection would damage or cause malfunction to the same, the device being characterized by a resistive means capable, first of all, of repeatedly momentarily withstanding the aforesaid voltage while, at the same time, slowing down the rate of change of the static electrical charge transferred to the protective device to a level equal to or less than that of the rate of change of the internal signals generated within the protected apparatus. Secondly, the protective device, while slowing down the rate at which the static electrical charge is transferred to the protective device to the aforementioned level, must also do so within approximately the shortest time interval (approximately 100 milliseconds) a person can touch the protective device, react to the fact they have done so and remove his or her finger therefrom. Third, the capacity of the protective device to accept the static electrical charge from the person must be a small fraction of the capacity of the transferor's body to hold the charge thereby minimizing the transfer of the charge from the latter to the former. Finally, the protective device must be capable of receiving the static discharge from the person without causing such person any significant pain.

12 Claims, 2 Drawing Figures

STATIC DISSIPATOR FOR ELECTRONIC DEVICES

Figure 1:
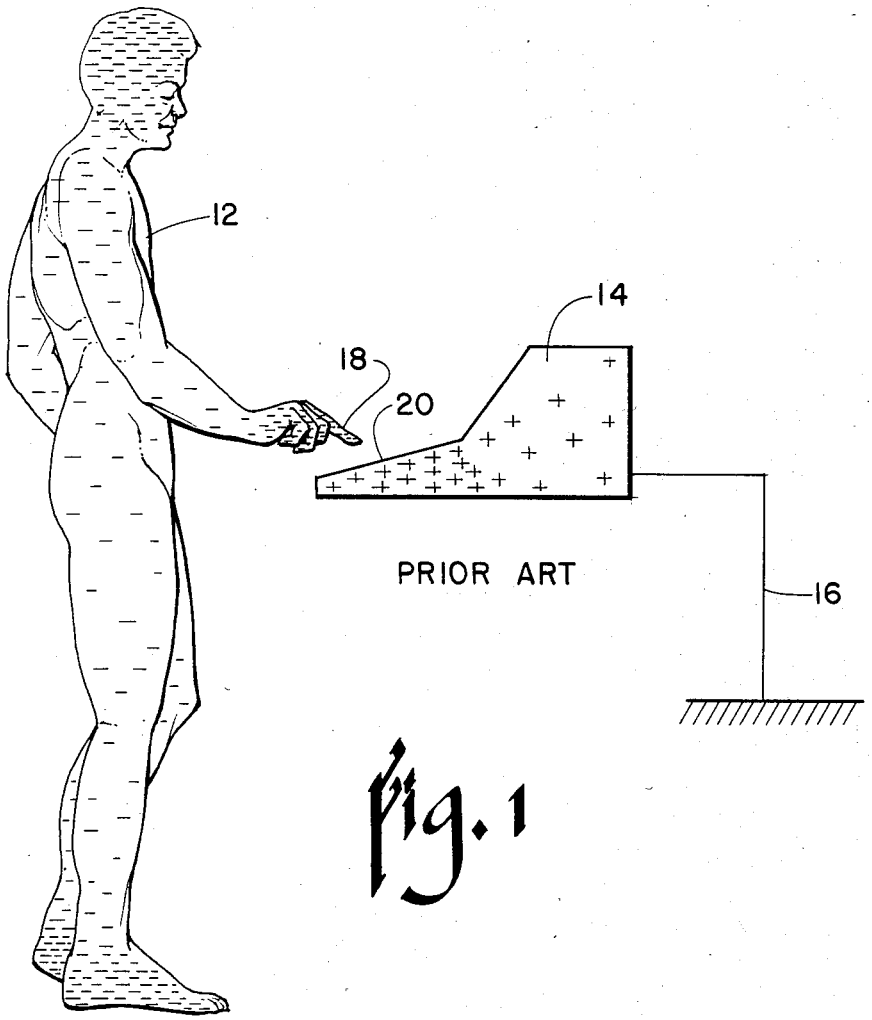

Some types of electronic equipment, particularly computer systems, are very sensitive to static electrical discharges. Merely walking across a carpet during conditions of low humidity can cause a person's body to build up a static electrical charge of as high as 30,000 volts and such a charge, if allowed to reach a computer, its peripherals or related equipment, can cause altered memory, loss of programs and erroneous data entry. Obviously, this is an intolerable situation which must be avoided if at all possible.

Devices for dissipating static electrical charges are old in the art and, of those known to applicants, their primary purpose has usually been that of protecting the person from pain, not a piece of inanimate equipment from some other kind of damage. For instance, in the logging industry where chains were lowered by helicopter to loggers waiting on the ground to fasten fresh-cut timber to them so it could be airlifted to the sawmill or nearby waterway, truck access point or the like, the loggers were reluctant to grab ahold of the chain because of the painful experience likely to result as a build-up of static electricity was discharged through their bodies into the ground. This particular problem was rather easily solved by incorporating a high resistance in the line from the charge-carrying device (the helicopter) to the person on the ground thus, in accordance with Ohm's law, reducing the current reaching such person to a level where it was not painful.

In terms of equipment protection in contrast to protecting the person, suppression of the rapid current and voltage changes that accompany such discharges of electrostatic energy as a lightning strike have always been a problem to the telephone companies. They, too, have handled the problem by inserting a resistance in series with the charge equalizing current flow as a means for reducing the value of the current reaching the equipment requiring protection.

In both of these situations, however, the problem is merely one of protecting the person or a piece of electrical or electronic equipment from the consequences of momentary surges of current at levels above that which the equipment is capable of handling. Unfortunately, the problems associated with protecting a piece of electronic equipment like a computer system from the ravages of static electrical discharges is not a simple one although many persons who lack the technical knowledge to understand and appreciate what is taking place think otherwise. For instance, few people realize that a human being can hold a charge capable of generating a 30,000 volt arc or especially that this arc is transferred to the equipment to be protected in a few billionths of a second. Even fewer are cognizant of the fact that the rate of change of the voltage and the current in such a static electrical discharge is several hundred thousand times faster than the rates of change of the voltages and currents normally generated within the equipment to be protected and, furthermore, even if they were aware of this tremendous disparity between these rates of change, even fewer would appreciate what it meant in terms of protecting the static-sensitive apparatus or what to do about it. The trade-offs that must be considered between slowing down the rate of change of the voltage and current present in the generated arc versus taking too long a time to dissipate it while still protecting against the maximum practical discharge the system is likely to see is even more mysterious a phenomenon, yet, one that must be given careful attention. Eliminating any significant pain experienced by the person carrying the charge as he or she dissipates it to ground is, of course, always a consideration but, perhaps, the easiest of those to handle.

Probably the least known or appreciated of the several factors that must be taken into account in designing a protective device of the type under consideration here is that of making sure a very large mismatch exists between the person's capacity to carry the electrical charge and the capacity of the protective device to receive it. For instance, one traditional approach to the solution of the static discharge problem is that of placing large grounded floormats and the like made of conductive material in the area where the equipment to be protected is located. Presumably, when this is done, the person carrying the charge will dissipate same through such a protective device before they can make contact with the apparatus being protected and thus prevent the charge from being transferred to the latter. Applicants have found, however, that this is decidedly the wrong approach since, by so doing, the capacity of the protective device to accept the charge more nearly approaches the capacity of the person holding the charge to carry same. The net result is that the total charge is shared between the charge-carrying entity and the charge-receiving entity in proportion to their respective charge-carrying capacities and the charge holding capacity on the large area floormat or similar unit is much larger than it should be.

It has now been found in accordance with the teaching of the instant invention that to make a truly effective protective device one must, first of all, slow down the rate of change of the voltage and current within the static discharge to a level more nearly compatible with the rates of change of those currents and voltages generated within the apparatus requiring protection. Best of all, the rates of change of the signals present in the static discharge should be at least as low as those internal signals present in the equipment when it is operating normally because these signals are already being tolerated, or presumably so, without any unwanted side effects.

If it is possible to essentially match these rates of change of the signals in the protective device with those generated internally in the apparatus to be protected, then the next consideration must be one of making sure that those currents and voltages appearing in the protective device as a result of an electrostatic discharge have not been slowed down to the point at which the person carrying the charge will be unable to discharge it by means of a momentary touching or contact with the latter because, otherwise, there will be a residual charge left when contact is broken off that can still cause a disruption in the system.

For effective protection, the capacity of the protective device must be reduced to a minimum in order to reduce the charge transferred during the time of charge redistribution. Saying this another way, since the charge carried on the body of the user is shared by the protective device, their relative capacities to carry this charge must be selected such that as little charge as possible is transferred from the former to the latter. The current produced during the charge redistribution period is not limited by the protective device resistor and, thus, the current is simply minimized by minimizing the capacity of the protective device. After the charge redistribution period is over, the main charge on the person or user will be transferred to ground through the protective resistor in the controlled manner of a slow RC discharge.

It is, therefore, the principal object of the present invention to provide a novel and improved protective device for guarding computer systems and other sensitive electrical and electronic equipment from the hazards of static discharges.

A second objective is the provision of a device of the type described which, among other features, slows down the rate of change of the current and voltage of the static discharge to a rate no higher than that of the normal signals generated within the equipment to be protected.

Another object of the within-described invention is to provide an essentially painless static discharge control device wherein the relative capacitances of the charge acceptor and the charge carrier are heavily weighted in favor of the latter.

Still another objective is that of providing a device of the type herein disclosed and claimed in which a near minimum practical touch interval becomes effective to dissipate an entire static charge of approximately the maximum voltage that can be carried by a human being.

Further objects are to provide a static discharge control device that is simple, compact, lightweight, reliable, safe, effective, versatile, relatively inexpensive and even somewhat decorative.

Figure 2:
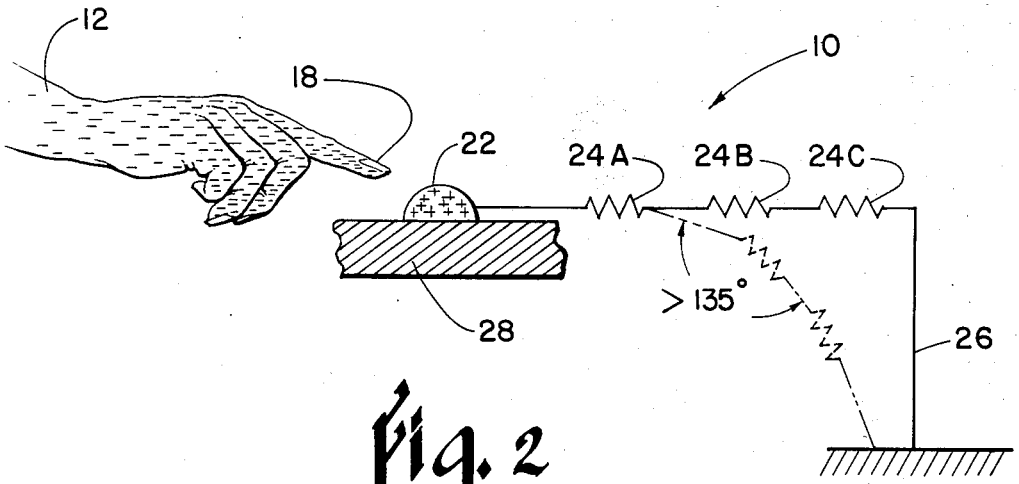

Other objects will be in part apparent and in part pointed out specifically hereinafter in connection with the detailed description of the drawings which follow and in which:

FIG. 1 is a schematic view showing an outline of a person standing in front of a computer terminal with his or her hand outstretched toward the keyboard and with plus (+) and minus (−) symbols representing the charge distribution; and, FIG. 2 is a schematic view, again with charge distribution, showing the static dissipator device grounded and about to be touched.

Before explaining the operation of the static dissipator or so-called "protective device" 10, it is, perhaps, desirable to digress for a moment and explain how operation of an electrostatic circuit differs from the operation of a classical electric circuit. Since static electricity is an excess of charge, it may be moved anywhere. An equal and opposite charge will exist somewhere (conservation of charge) but they need not neutralize each other in any defined length of time. Charge travels very rapidly from cloud to ground or ground to cloud (the latter predominating) during a lightning strike but the return current, which is natural ion current, may take days to weeks. Lightning represents a current which may be greater than 100,000 amperes while the natural ion return current rarely exceeds a microampere in the same cross sectional area. Thus, in electrostatics, it is not necessary to have a complete circuit (go and return current). As a matter of fact, the charge may jump from one object to another so that the original charge redistributes between the two objects and never returns to the original one. When the charge jumps between the objects it does so violently in the form of an arc which may represent hundreds of amperes and thousands of volts, but, there is no return current nor is a closed circuit involved at all. Thus the electrostatic phenomenon only represents a redistribution of charge, not the event described by classical closed-loop circuit theory. The time constant of the current in the arc does not, therefore, depend upon the inductance, resistance and capacity of the circuit loop, but instead, it only depends upon the character of the non-continuous current path, i.e., the capacity, inductance and resistance of the two objects and the resistance and inductance of the arc path between the two. Accordingly, because the earth is a very large object with a very large capacity, it can absorb a very large charge without an appreciable change in voltage. It becomes, therefore, a charge sink. The dissipation of a charge can thus best be accomplished by directing the excess charge to earth where it will be absorbed without a measurable change in potential.

In order to properly explain the operation of the "protective device" which has been indicated in a general way by reference numeral 10, it is first necessary to understand the character of electrostatics and of electrostatic discharge. Electrostatics is a surface phenomenon which results from an excess electrical charge. This can be a positive charge (a deficiency of electrons) or a negative charge (an excess of electrons). When a charge is placed upon an object which is a non-insulator, the charge will distribute itself such that the individual charges are as far apart as is practical because like charges repel one another. This repulsion of the charges is what makes electrostatics a surface phenomenon. The force between charges is defined by Coulomb's Law. The redistribution of charge on the object is such that the forces on each charge equalize taking into account the fact that they cannot leave the surface of the object. The charge on a sphere would, therefore, be a uniform one spread over its entire surface. Conversely, the charge on a rod would be highly concentrated at its ends.

The protective device 10 must deal with the charging of a human being with electrostatic energy and his or her subsequent discharge. A human being becomes charged either by static induction or tribo-electric charging. Normally the latter phenomenon is what causes a person to become charged. Since a human being has a highly non-uniform shape and, in addition, can change shape at will, the charge distribution over the body is highly non-uniform. For instance, when standing erect with the arms down at the sides, the charge will concentrate at the head and at the feet. If, on the other hand, one were to stand erect with one or both arms and hands extended, there will be a concentration of charge on the fingers, at the head and on the feet as has been represented schematically in FIG. 1 by the minus signs distributed over the standing figure. In the seated position with the arms extended, the concentration of charge at the fingers would be even further intensified.

When a human being becomes charged by shuffling his or her feet across a rug, that charge can be dissipated by touching ground. When the person dissipates the charge in this manner, however, the result is a violent arc which, as aforementioned, is painful and creates an electromagnetic disturbance. The large currents and voltages involved and their very rapid rate of change result in the radiation and conduction of a portion of the consequences of the event to adjacent objects. This conduction and/or induction may cause damage and/or degradation of performance to the adjacent objects, in this case computer terminal 14 as has already been noted. It, therefore, becomes necessary to try to either eliminate or at least control the static charge in such a way that it is conducted to ground without the violence of an arc. This is accomplished by providing a touchpoint 22, a resistor or series thereof 24, and a connection to ground 26, all of which have been shown in FIG. 2 to which detailed reference will presently be made. Knowing this, unfortunately, does not produce a protective device which will be effective to prevent damage to the apparatus requiring protection such as the computer terminal 14.

If the charged object is a human being 12 shown in FIG. 1 and he or she comes near the object (computer terminal 14) that is grounded there is an induced charge placed on the object by the person's charge. This has been demonstrated schematically in FIG. 1 to which reference will now be made and which shows that the negative charge on the person 12 causes a positive charge to be conducted up the grounded wire 16 of the computer terminal 14 to match the person's charge by attraction of unlike charges. As the person's finger 18 gets closer and closer to the grounded surface (keyboard 20), the negative and positive charges concentrate more and more until the voltage field between the two exceeds the breakdown potential of the intervening air. At this point an arc discharge occurs which neutralizes the charge on the person either partially or completely. The discharge is a transfer of electrons and/or ions which occurs very rapidly (1 to 10 nanoseconds). The discharge current at 20,000 volts on the person would be on the order of 300 amperes peak current. A current of this magnitude entering a person's skin would result in that person experiencing a sharp pain at the point of entry.

Because the aforementioned static discharge takes place in a few billionths of a second, its time frame is utterly incompatible with what the computer can handle. Saying this another way, the currents and voltages inside the computer are moving at rates several hundred thousand times slower than the static discharge and the latter, when it triggers in the form of an arc, creates a field that is highly disruptive of the sensitive internal workings of the computer, particularly the memory devices which hold the software which, in turn, controls the operation of the computer. Applicants have now discovered that the first of several requirements to handle such discharges effectively and prevent them from harming sensitive equipment is to slow down the rate of the discharge to a speed compatible with the rates of those signals moving around in the computer during its normal operation. If, obviously, the computer is handling these signals without disruption, it can do likewise with the static discharge provided the latter does not differ significantly therefrom.

For example, assuming that the apparatus to be protected is a so-called "digital device" containing digital logic circuits which operate at a 5 volt level with speeds as fast as 60 nanoseconds (10 times gate delay in TTL logic), then it can be shown that to be effective, the resistance element must be sized such that the RC time constant of the protective circuit is a minimum of at least 1 millisecond. This means that such a device must operate with voltages that are changing at a rate of $83\frac{1}{3}$ million volts per second ($5/60*10^{-9}$). If the 30,000 volt maximum discharge has a 1 millisecond time constant then the voltage is changing at a maximum rate of 81.54 million volts per second (30,000 * e/0.001). Thus, limiting the arc discharge to a time constant of 1 millisecond will reduce its effect on the device to that level which is contained within the device.

More specifically, applicants have found that the protective device 10 in the electrostatic circuit diagram should contain as a minimum a resistance of approximately 30 megohms. In the particular form illustrated, this resistance is supplied by resistors 24A, 24B, and 24C wired in series. The best design would be a 30 megohm resistor which was very small in diameter and just long enough to have an onset voltage of 25 to 30 KV. The power rating of the resistor can be very low (less than $\frac{1}{4}$ watt $-\frac{1}{2}CV^2=0.225$ Joule$=0.225$ watt seconds with 30 KV and 500 picofarads). The resistor need not be rated at 30 KV because of the transient nature of its operation and low power requirements. The resistor can have a very wide tolerance. Values from 10 megohms to 60 megohms plus or minus 50% would perform the function adequately but 30 megohms would be the optimum value.

Three 10 megohm $\frac{1}{2}$ watt composition resistors (as opposed to dipped resistors) in series perform the function at the least cost. Three resistors are required to obtain a 25 KV standoff voltage (to a transient 25 KV voltage not a steady voltage). Dipped $\frac{1}{2}$ watt resistors have a metal cap on the ends of the resistance element and, therefore, have a much shorter gap between the ends which results in an inferior standoff voltage. The three resistors in series may be formed in a straight line (full lines in FIG. 2) or have a slight bend between each resistor (phantom lines in FIG. 2). The angle between adjacent resistors cannot be less than approximately 135° or the voltage will jump around the two or three resistors and the full standoff voltage will not be attained.

The set of three resistors must be insulated (insulator 28) to 25–30 KV from the surface upon which they are mounted so that arcing to the mounting surface will not occur. There must be an adequate insulated distance from the touchpoint 22 or end of the resistor (if there is no touchpoint) to have a standoff voltage of 25–30 KV. The required separation can be anywhere from between approximately 0.8 to 1 inch and still attain the required standoff because of the transient nature of the operation. This is true because the transient is not there long enough for a corona to develop and ionize the air around the touchpoint thereby greatly increasing the necessary flash over distance.

The charge-carrying entity or person 12 can be characterized as an RC circuit where the resistance R has a value of between approximately 50 and 1500 ohms and the capacity is 10 to 500 picofarads. The rather large variation in resistance is mainly due to the moisture on the skin; whereas, the capacity difference is created by trying to simulate the effect of a large charged object (a person) by a lumped constant component (capacitor). Capacity is a characteristic that defines the relationship between voltage and charge. The electrostatic capacitance is defined as the charge on one conductor divided by the potential difference between the two conductors:

$$C=Q/V \text{ or } Q=CV$$

where Q is in Coulombs, V is in Volts, and C is in farads. Large capacity is then the ability to hold a large amount of charge at a low voltage.

Now, since the total charge carried by the charge-carrying entity (the person) is shared with the charge-receiving entity (the protective device) in direct ratio to their respective charge-carrying capacities, the emphasis applicants have discovered should be one of keeping the charge-carrying capacity of the receiving entity as small as possible which, as aforementioned, is contrary to the teaching of the prior art static dissipation devices. The charge-carrying capacity of a person is, of course, a function of his or her size but, even so, it doesn't vary so much that it cannot be considered a constant for purposes of designing an adequate and effective protective device. The user of the device will have a nominal resistance of 150 ohms and a maximum capacity of 500 picofarads, these values having been determined empirically and accepted by the industry. Based upon these empirical values, the maximum time limit for dissipation of the charge should be approximately 100 milliseconds which is short enough to insure that the entire charge will be dissipated by a momentary casual touch.

It is of utmost importance to reduce the capacity of the resistance element to a minimum in order to reduce the rate of change of voltage and current during the charge dissipation period. If, for instance, the capacity of the protective device exactly matched the capacity of the user's body and such charge was the maximum of about 30,000 volts, then immediately upon such person making contact with the protective device, half the total charge or 15,000 volts would be transferred to the latter via the touch point. A 15,000 volt static discharge will produce a significant arc or spark and could be painful provided the current was above about 1 milliampere which is the pain threshold. This being the case, an effort should be made to hold the charge-carrying capacity of the protective device to a minimum and if, in the above example, the area of the protective device were, say, 1/1OOOth of that of the user's body, then the charge transferred would only be a mere 15 volts which is negligible.

Reducing the capacity of the resistance element 24 is accomplished by properly configuring the resistance element and the touch point 22 where the charge carrying entity or user must touch his or her finger tip 18 in order to dissipate any charge. This point should be made as small as possible or, alternatively, made of a material having a high resistance per unit area which translates into a long RC time constant per unit area in comparison to the time of the arc discharge. If, therefore, as previously mentioned, the RC time constant is between approximately 1 millisecond and a maximum of approximately 17 milliseconds, the charge will be transferred by a momentary touch regardless of whether the protective device is based upon making contact with a discrete point or a random point on a sizeable area. The 17 millisecond limit is necessary so that 5.7 time constants are available before the 100 milliseconds of the touch is over. Five and 7/1Oths time constants will allow 30,000 volts to be reduced to 100 volts which is considered safe.

The particular touchpoint 22 shown in FIG. 2 consists of a small button of conductive material with rounded edges accessible to the person 12 carrying the charge. As the user's finger 18 approaches the touchpoint 22, there will be an arc which, if the dissipator device 10 is properly designed, will neutralize the induced charge indicated by the plus (+) signs in both FIGS. 1 and 2 and charge the touchpoint by redistribution of the charge carried on the person's body to a voltage slightly lower than that of the person, all without pain. The voltage difference is due to the arc resistance which is approximately 10 ohms, the inductance which amounts to about 1/1Oth of a microhenry, and the start of conduction of the charge through the resistor bank 22.

The conduction of the charge away from the touchpoint through the 30 megohm resistor will reduce the voltage on the touchpoint and thus increase the voltage between it and the hand. At the same time the voltage on the touchpoint is being reduced, the hand is moving toward the touchpoint thereby decreasing the distance therebetween and increasing the field intensity (volts/meter). This combination of the increase in voltage between the touchpoint and the hand along with the rapid increase in field intensity soon produces a condition where another arc will occur, and when it does, it will be small and take place with only a redistribution of charge since any induced charge would already have been neutralized by the charge on the touchpoint. This process will recur over and over again until the finger actually makes contact with the touchpoint; whereupon, following the touch of the finger, the charge on the person is conducted through the 30 megohm bank of resistors with a current wave having a time constant very nearly equal to that of the nominal capacity of the person and the 30 megohm resistor (200 picofarads times 30 megohms=6 milliseconds). The worst case time constant would be 500 picofarads times 30 megohms which equals 15 milliseconds. The electromagnetic disturbance is very low compared to the arc which would occur without the device due to the following being very low:

1. rate of change of voltage and current;
2. peak current 1 milliamp for 30 KV; and,
3. redistributed charge due to low capacity of the touchpoint.

Theoretically, the device can be made even simpler by eliminating the touchpoint and touching the resistor directly. If this were done, then there would be almost no capacity in the touchpoint and the arc would have been eliminated altogether. In practice, this is not possible because the resistor material itself represents an electrostatic capacitor which can hold charge. It is significant to note in this connection that it is not necessary to provide the circuit with resistors capable of sustaining a load of 30,000 volts, but rather, only ones that can do so repeatedly over short intervals of the duration of a fraction of a second or thereabouts.

Thus, protective device 10 can completely and safely discharge a 30,000 volts charge in about 1/1Oth of a second and do so at a rate which is at least as slow as, if not slower than, the rate at which the voltages and currents within the circuitry of the computer are changing. If, on the other hand the resistance is much above 30 megohms, then the time interval it takes for dissipation of the static charge becomes overly long and there is a possibility that the person carrying the charge can remove his or her hand from being in contact with the protective device before all the charge is dissipated. Looking at this another way, the higher the resistance, the longer the interval required to completely dissipate the static charge through the protective device and, therefore, if the normal response time for a person to casually touch the contact point or area 22 of the protective device 10, react to having done so and remove their hand therefrom is in the order of 100 milliseconds, then, as a practical matter, this becomes the longest of the time intervals that can be reasonably tolerated before there is a chance of some of the charge being left on the person's body at the time contact is broken.

What is claimed is:

1. The static dissipator for protecting computer systems and other digitized electronic equipment of the type designed to operate at voltages that are changing at rates less than approximately 100 million volts per second which comprises: a conductive element defining a touchpoint locatable in close proximity to the equipment to be protected and accessible to a person constituting a potential charge-carrying entity, said conductive element having a charge-carrying capacity which is smaller than the charge-carrying capacity of the charge-carrying entity; and, grounded resistance means electrically connected to said conductive element sized and adapted so that an arc discharge time constant has a value of no less than about one half millisecond to effectively surpress the rates of change of the currents and voltages accompanying the discharge of any electrostatic energy carried by said charge-carrying entity to be slow enough to be no greater than that rate of change of currents and voltages at which the equipment to be protected is designed to operate yet will occur fast enough so that within a time interval of no greater than approximately 100 milliseconds the charge on the charge-carrying entity is reduced to a level that is safe for the equipment being protected.

2. The static dissipator of claim 1 wherein: the resistance means has a resistance of approximately 30 megohms.

3. The static dissipator as set forth in claim 2 wherein: the resistance means comprises three approximately 10 megohm resistors having a power rating of between approximately $\frac{1}{4}$ and $\frac{1}{2}$ watt wired in series with one another and cooperating to provide approximately a 25 to 30 KV intermittent standoff voltage.

4. The static dissipator as set forth in claim 3 wherein: the angle between adjacent resistors is not less than approximately 135°.

5. The static dissipator as set forth in claim 3 wherein: the resistors each comprise $\frac{1}{2}$ watt composition resistors.

6. The static dissipator of claim 2 wherein: the resistance means has a tolerance of between approximately 10 megohms and 60 megohms plus or minus 50%.

7. The static dissipator of claim 1 wherein: the conductive element has an RC time constant per unit area that is long in comparison to the time of the arc discharge from the charge-carrying entity.

8. The static dissipator as set forth in claim 7 wherein: the conductive element has an RC time constant that is appreciably longer than 1 millisecond but less than approximately 17 milliseconds.

9. The static dissipator of claim 1 wherein: means comprising an insulating medium is interposed between the touchpoint of the protective device and a surface on which it is mounted which will be effective to standoff a voltage of between approximately 25 and 30 KV.

10. The static dissipator as set forth in claim 9 wherein: the insulating medium is air and the distance separating the conductive element from the mounting surface is greater than approximately 0.8 inches.

11. The static dissipator of claim 1 wherein: the resistance means is shaped to standoff and prevent arc-over of voltages not substantially greater than approximately 30,000 volts.

12. The static dissipator of claim 1 wherein: the resistance means is of the composition type.

* * * * *